US008645239B2

(12) United States Patent
Swaminathan et al.

(10) Patent No.: US 8,645,239 B2
(45) Date of Patent: Feb. 4, 2014

(54) SYSTEMS AND METHODS FOR ADVANCED METERING INFRASTRUCTURE CUSTOMER PORTAL

(71) Applicant: Florida Power & Light Company, Juno Beach, FL (US)

(72) Inventors: Radhakrishnan Swaminathan, Jupiter, FL (US); Paul J. Ollukaren, Palm Beach Gardens, FL (US); John Alan McCormick, Stuart, FL (US); Timothy Wayne Moore, Tequesta, FL (US); Steven David Shnider, Wellington, FL (US); Robert Obeso, Miami, FL (US)

(73) Assignee: Florida Power & Light Company, Juno Beach, FL (US)

( * ) Notice: Subject to any disclaimer, the term of this patent is extended or adjusted under 35 U.S.C. 154(b) by 0 days.

(21) Appl. No.: 13/668,697

(22) Filed: Nov. 5, 2012

(65) Prior Publication Data

US 2013/0144769 A1 Jun. 6, 2013

Related U.S. Application Data

(60) Provisional application No. 61/555,291, filed on Nov. 3, 2011.

(51) Int. Cl.
*G08C 15/06* (2006.01)

(52) U.S. Cl.
USPC ..... 705/34; 705/37; 705/7.29; 705/80; 705/412; 705/26.3; 702/179; 702/61; 340/540; 340/506; 709/224

(58) Field of Classification Search
USPC ..... 705/34, 14.11; 340/870.02; 700/291; 715/769, 762; 702/187
See application file for complete search history.

(56) References Cited

U.S. PATENT DOCUMENTS

| | | | | |
|---|---|---|---|---|
| 8,117,555 | B2 * | 2/2012 | Samson et al. | 715/769 |
| 8,255,186 | B2 * | 8/2012 | Mukhi et al. | 702/187 |
| 8,266,537 | B2 * | 9/2012 | Cho | 715/762 |
| 8,286,086 | B2 | 10/2012 | Sampson et al. | |
| 8,296,360 | B2 | 10/2012 | Polis et al. | |
| 2010/0293045 | A1 * | 11/2010 | Burns et al. | 705/14.11 |
| 2012/0197449 | A1 * | 8/2012 | Sanders | 700/291 |

* cited by examiner

*Primary Examiner* — Vanel Frenel
(74) *Attorney, Agent, or Firm* — Feldman Gale, P.A.

(57) ABSTRACT

In accordance with one embodiment, a system is provided that uses historical and current energy usage data generated by advanced metering infrastructure (AMI) meters to allow users conduct an analysis of energy usage via a portal. In accordance with one embodiment, a tool is provided to allow customers to display an estimated next month bill.

20 Claims, 8 Drawing Sheets

600

SYSTEMS AND METHODS FOR ADVANCED METERING INFRASTRUCTURE CUSTOMER PORTAL

FIELD OF THE INVENTION

Embodiments of the present invention generally relate to transmission of power to an end user, and more particularly to management and analysis of data generated by devices comprising an advanced metering infrastructure (AMI) such as electricity meters, gas meters, water meters and the like.

BACKGROUND OF THE INVENTION

Electricity generated at a power station may be produced using a plurality of energy sources, such as coal powered power station, nuclear fission, wind, or solar photovoltaic ("PV") cells, etc. This power generated at the power station is transmitted to users over a transmission grid. In recent years advancements have been made in transmission of power to an end user. One such advancement has been in the area of electrical power meters.

An electrical power meter may be implemented as an automatic meter reader (AMR) where the electricity usage is communicated one way to a meter reader. More recently, AMI meters have been developed. AMI meters differ from traditional AMRs in that they enables two-way communications between meters and an AMI command and control system. AMI command and control system may receive data from the AMI meter and communicate it over a network to remote locations. Also, AMI command and control systems may send data to electric meters to perform various tasks.

The use of AMI data has been limited to suppliers, utility companies and service providers. However, a need exists for providing customers with tools to exploit the potential of AMI generated data.

SUMMARY

The following presents a simplified summary of the invention in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In one embodiment, the invention includes use of a web-based application, running on a computer or mobile device, or customer portal that provides customers of a utility with tools that allow comparison of monthly, daily, and hourly periods of energy usage. The analysis is based on real-time or near-real-time data collected from smart meters/AMI meters, Home Area Network ("HAN") pricing, and other information. The customer portal may also provide utility customers an analytical tool for graphical, tabular and numerical analysis of the customer's anticipated energy usage and generation data. The customer portal may also provide utility customers an analytical tool for graphical, tabular and numerical analysis of the customer's historical energy usage and energy generation data. Novel features of the invention include the use of widgets customized depending on the customer profile, including tying together widgets and tying data sources into the widgets, processing the usage data such that customers' displayed usage will closely match the bill sent to the customer, and the integration of AMI meter readings into the system.

These features and advantages of the present invention will become more readily apparent from the attached drawings and description of illustrative embodiments, which follow.

BRIEF DESCRIPTION OF THE DRAWINGS

The drawings, in which like numerals represent similar parts, illustrate generally, by way of example, but not by way of limitation, various embodiments discussed in the present document.

DETAILED DESCRIPTION OF ILLUSTRATIVE EMBODIMENTS

The following detailed description of certain embodiments of the subject matter set forth herein, will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

In the following detailed description, reference is made to the accompanying drawings which form a part hereof, and in which are shown by way of illustration specific embodiments in which the subject matter disclosed herein may be practiced. These embodiments, which are also referred to herein as "examples," are described in sufficient detail to enable those skilled in the art to practice the subject matter disclosed herein. It is to be understood that the embodiments may be combined or that other embodiments may be utilized, and that structural, logical, and electrical variations may be made without departing from the scope of the subject matter disclosed herein. The following detailed description is, therefore, not to be taken in a limiting sense, and the scope of the subject matter disclosed herein is defined by the appended claims and their equivalents. In the description that follows, like numerals or reference designators will be used to refer to like parts or elements throughout.

Figure 1:
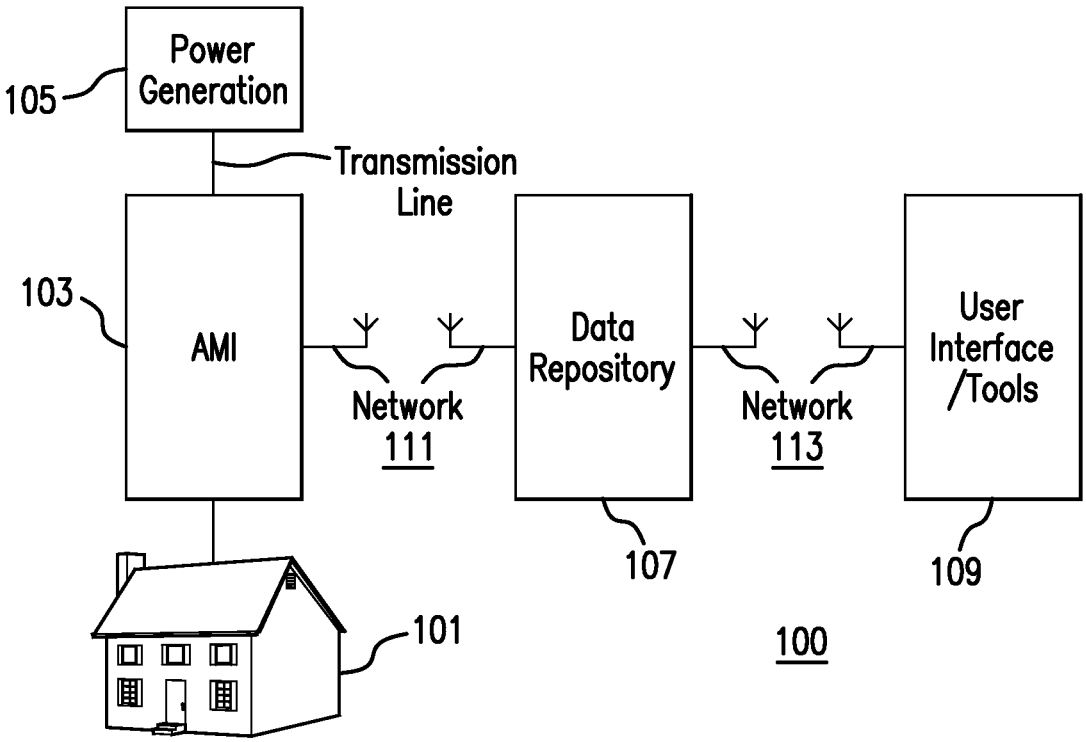
FIG. 1 illustrates a high level view of a system for management of AMI data in accordance with an embodiment.

FIG. 1 illustrates a system 100 for an AMI customer portal in accordance with an embodiment. The system 100 illustrates a power generation facility 105, an AMI module 103, and a customer's home 101 interconnected through a smart grid, for example. In one embodiment, the AMI customer portal 109 provides customers with tools that allow a comparison of monthly, daily, and hourly periods of energy usage. The customers may be able to access the data from a repository 107 on a real-time basis through use of network 113. Alternatively, the data may be accessed in a near-real-time manner. The data may be collected by the AMI module 103 from a plurality of sources and then transmitted through use of network 111 to the data repository 107. For example, the data may be collected from smart meters, HAN pricing 101, or any other component of the AMI. The system may also provide customers with analytical tools. The analytical tools may be for at least a graphical, a tabular, a numerical analysis, or the like of the customer's anticipated energy usage and generation data. The system may also provide the customers with an analytical tool for at least a graphical, a tabular, a numerical analysis, or the like of the customer's historical energy usage and energy generation data.

Optionally, the system may also have a plurality of widgets customized and/or customizable for individual customers. For example, the widgets may be customized based on the customer profile, i.e., the type of energy sources, the usage data, customer's preferences as to usage of electricity, customer's monitored usage habits, energy consumption data of the community where the customer is located, and the like. A user can have different user accounts and each account can have different profile. Also, a meter may be inquired remotely, to see if power is down at the meter and not inside a customer's home. Thus, one customer may have a plurality of customized profiles, from which a customer may select a profile to apply at any given time. Additionally, the customer may be able to manage or communicate with individual electric appliances.

In one embodiment, these systems may include hardware, software, communications interfaces, consumer energy displays and controllers, customer associated systems, Meter Data Management (MDM) software, supplier business systems, and the like. In one embodiment, the system may be hardware based, or software based, or any combination thereof.

Individual customer profiles may also show usage/consumption data that closely matches the usage information that will be sent to the customer in a bill. The subject matter disclosed herein enables a framework that helps development of widgets that are reusable and extendable. The subject matter disclosed herein may also enable a replicable portal that allows addition of widgets. In one embodiment, a customer may be a residential user. Optionally, the customer may be a commercial user. A network may be a wired network or a wireless network.

Figure 2:
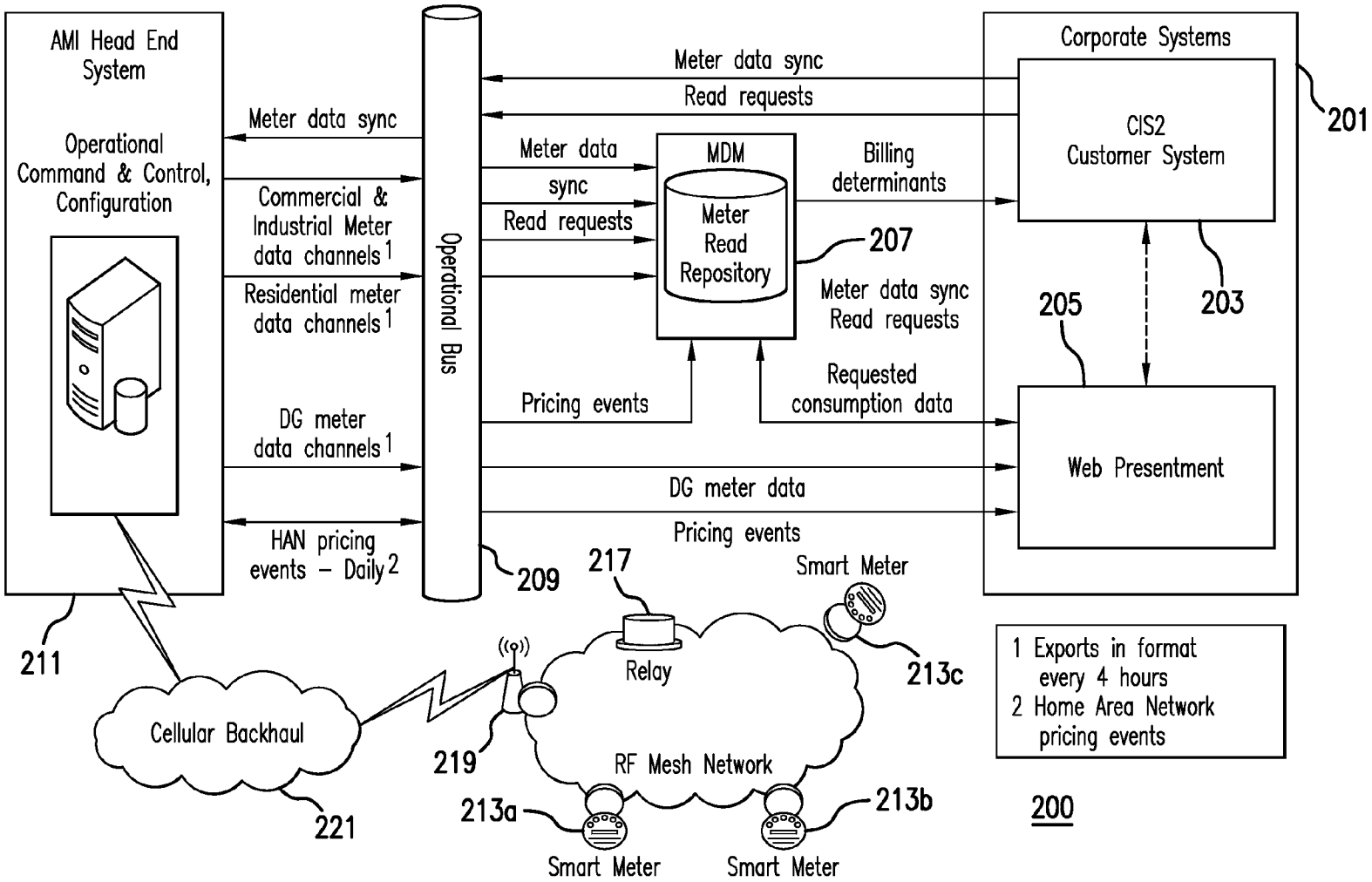
FIG. 2 illustrates a detailed view of a system for management of AMI data in accordance with an embodiment.

FIG. 2 illustrates a detailed view of the system 200 of the present invention in accordance with an embodiment. The system 200 includes a utility corporate computer system 201, including, for example, a server 203 (e.g., a CIS2 server) and web server 205; a data repository 207; an operational bus 209; an AIM head end system 211; a cellular network 221; an access point 219; a relay 217; and smart/AMI meters 213(*a*)-(*c*) interconnected through a mesh network 215.

The server 203 may be used to store customer account information that can be accessed by a customer through web server 205 after the user has been authenticated. The repository 207 may be used to store AMI meter data collected by the AMI Head End system 211, which is in communication with the repository 207 and the utility corporate system 201 through use of an operational bus 209.

The system 200 also includes smart or AMI meters 213(*a*)-(*c*) which collect customer data (e.g., energy consumption) and transmit the data to an access point 219 through use of a wireless mesh network. If a smart meter is not within detection reach of the access point 219, a relay 217 may be used to boost or repeat signals communicated between that meter and the access point 219. The access point 219 may serve as a two-way communications interface between the AMI head end system 211 and the meters 213. The meters 213 may be deployed in residential or industrial customer facilities. The access point 219 may communicate directly with the head end unit 211 through use of a cellular communications network 221.

In one mode of operation, the head end unit 211 sends commands and controls the operation of the meters 213 based on read request signals and meter data synchronization signals from the server 203. In response to these requests, the head end unit 211 transmits to the data repository 207 meter reads from commercial and industrial customer, meter reads from residential customers and pricing events. In one embodiment, the data repository 207 may be a meter data management ("MDM") module.

The head end system 211 may also transmit distributed generation ("DG") meter data reads and pricing events to the web server 205. A DG meter may be defined as a resource connected to the customer's load and located in close proximity to the smart meter to reduce the amount of energy that would otherwise have been produced by other capacity resources during particular pricing events. Pricing events may be defined as measured energy consumption during a variable pricing window, for example, based on Demand Resource On-Peak Hours, Demand Resource Seasonal Peak Hours, Demand Resource Critical Peak Hours, Real-Time Demand Response Event Hours, or Real-Time Emergency Generation Event Hours. Based on the received data, the repository 207 may generate billing determinants and transmit those determinants to the server 203 for generating customer bills. The billing determinants may be defined as rate structures and rebate programs associated with particular customers based on energy consumption during pricing events.

Figure 3A:
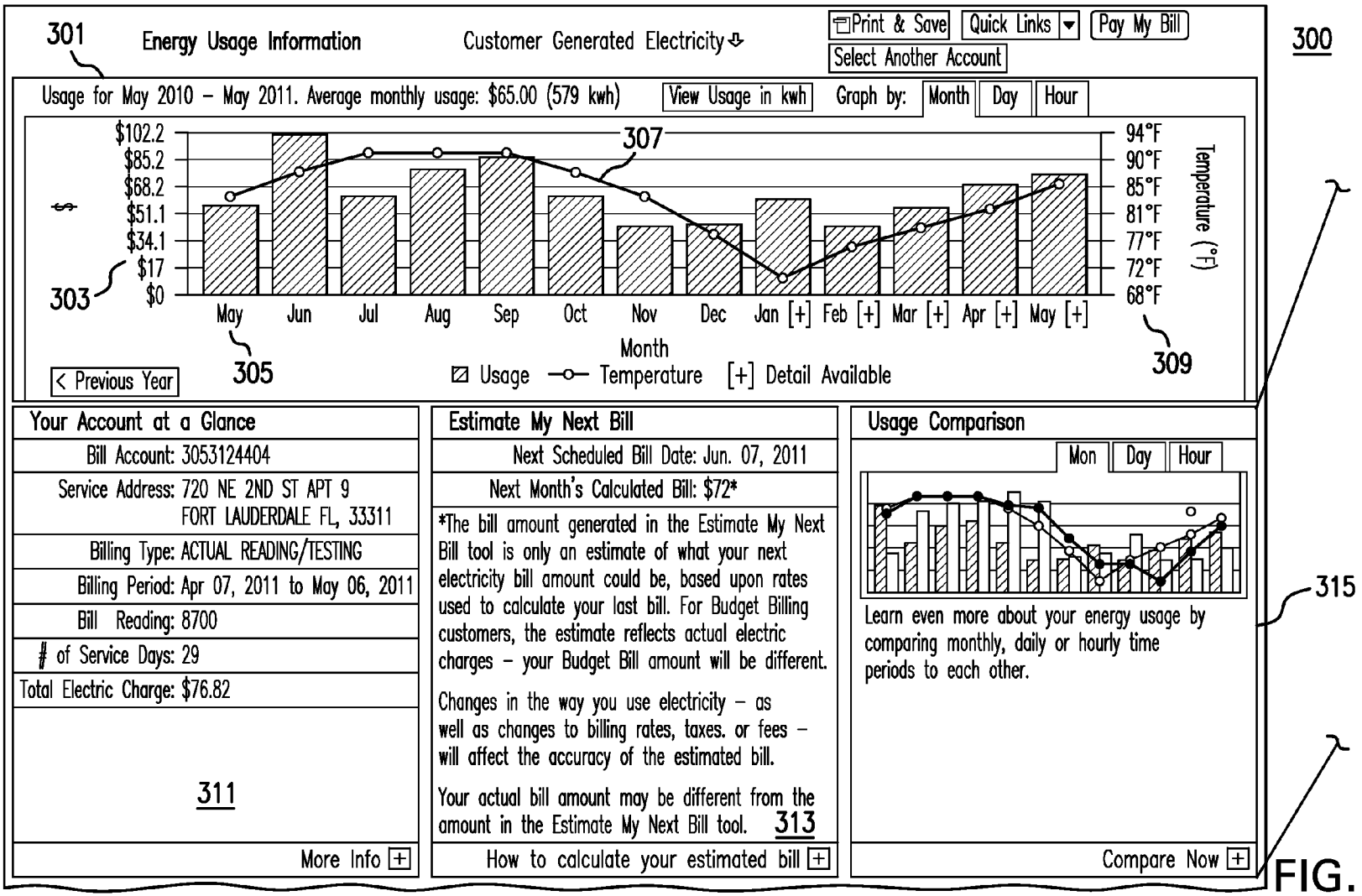
FIGS. 3A-3C illustrate partial views of a first user interface for the AMI customer portal in accordance with an embodiment.
Figure 3B:
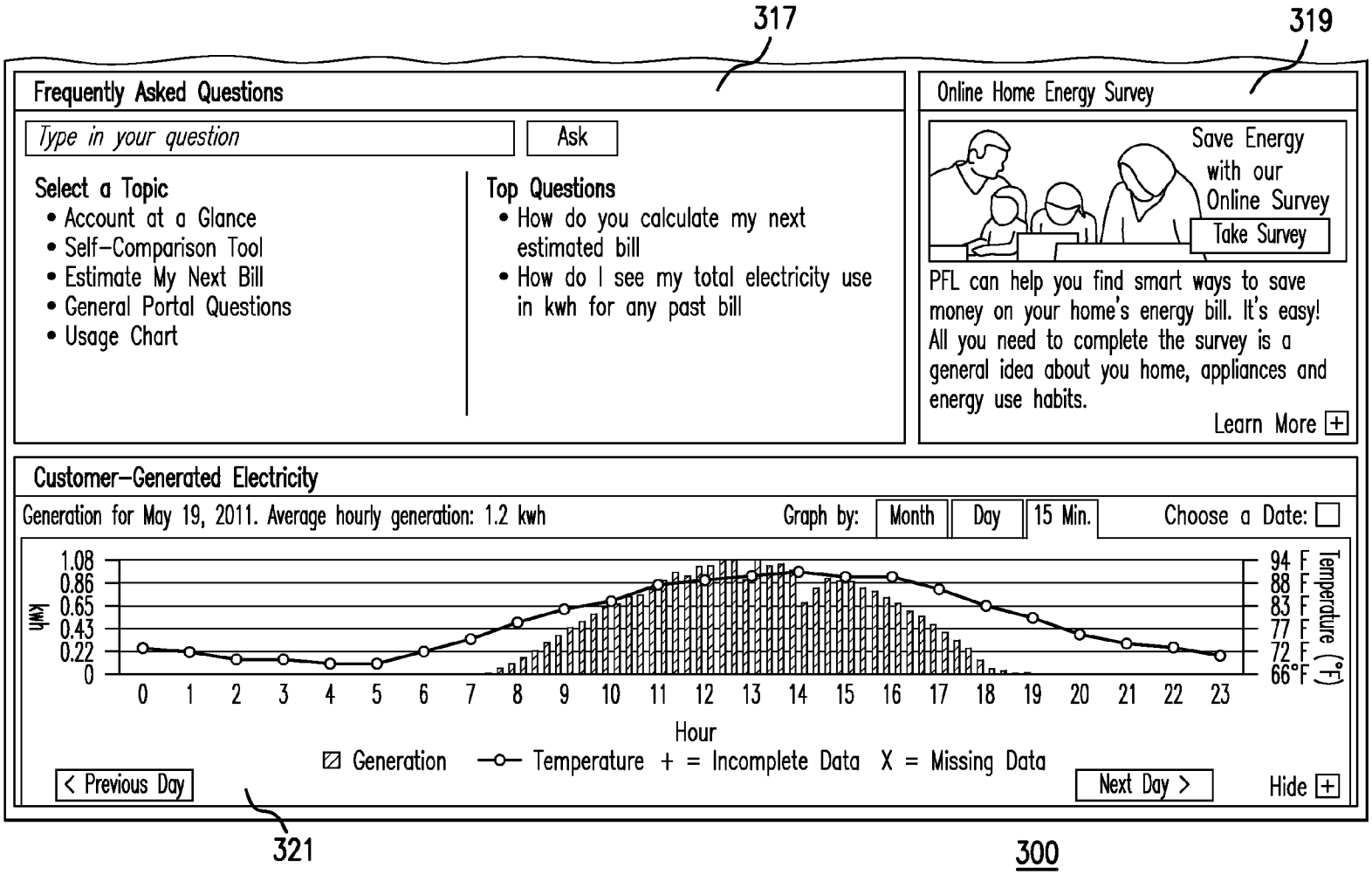
Figure 3C:
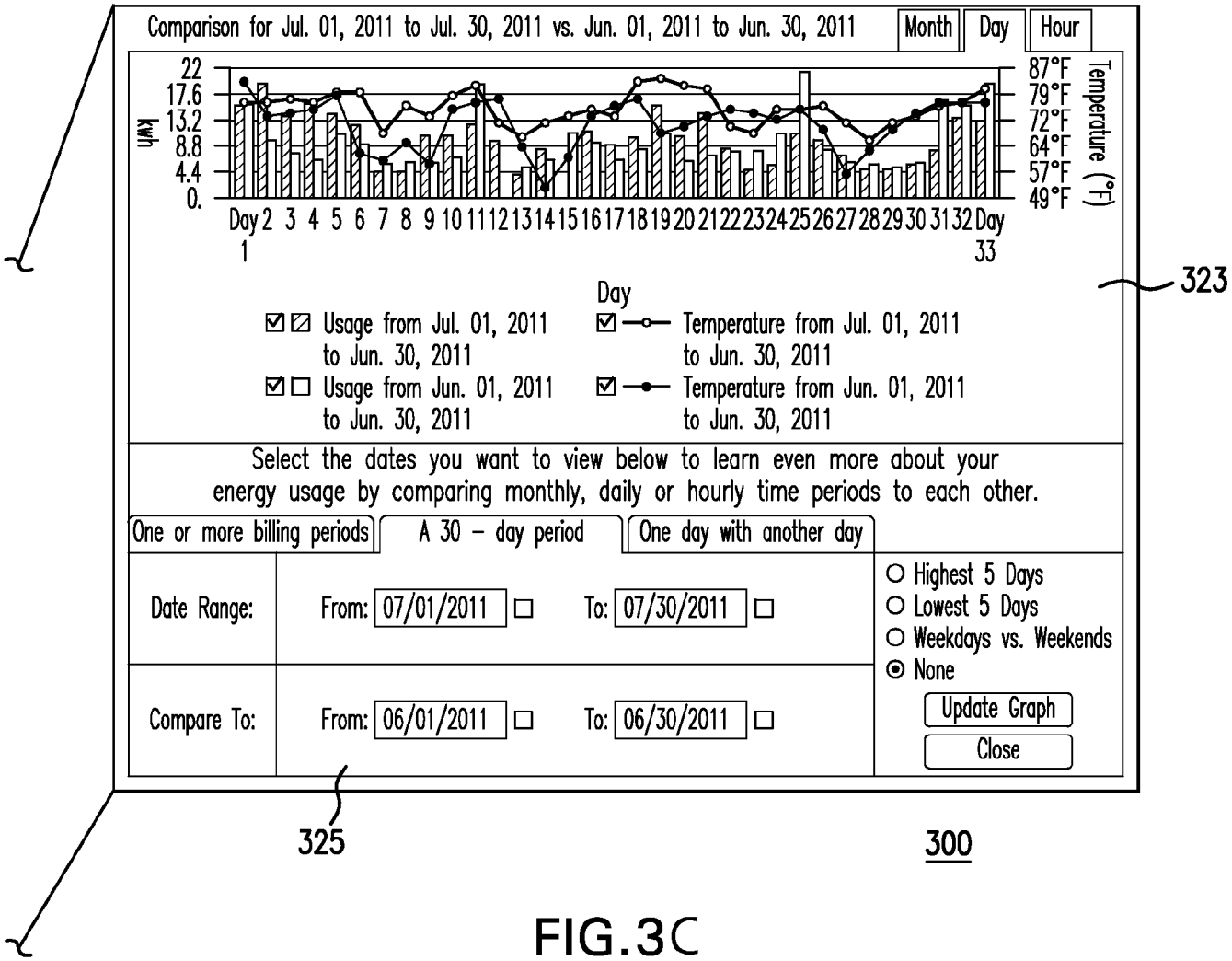

FIGS. 3A-3C illustrate partial views of a graphical user interface (GUI) for the AMI customer portal in accordance with an embodiment. The GUI 300 ties various widgets in the illustrated embodiment, specifically, an energy usage information widget 301, an account at a glance widget 311, an estimated bill widget 313, a usage comparison widget 315, a frequently asked questions widget 317 (FIG. 3B), a home energy survey widget 319 (FIG. 3B), and a customer generated electricity widget 321 (FIG. 3B). Use of widgets in computing apparatuses is known in the art. For example, U.S. Pat. Nos. 8,117,555; 8,255,186; and 8,266,537, incorporated herein by reference, disclose the use of widgets in computing devices for different applications.

Referring to widget 301, information gathered by smart meters 213*a-c* in FIG. 2 is organized and processed by the system 200 to generate the data displayed in widget 301. In the illustrated embodiment the data pertains to the customer's energy usage from May 2010 to May 2011. The widget 301 calculates the average monthly usage both in dollars and in kilowatts/hour. The widget 301 also displays the usage by month, day, or hour. In the embodiment of FIGS. 3A-C, the widget 301 displays energy usage on a monthly basis (305) in a bar chart format. The bar chart also displays the dollars spent by the customer on a monthly basis (303). Overlaying the bar chart display is a plot reflecting the temperature variation on a monthly basis (307), with the temperature being displayed in Fahrenheit degrees 309.

Widget 311 displays a summary of the customer account. The information that this widget may display includes account number, the customer address, a billing period, total electric charges, the type of billing, etc.

A main aspect of the present invention relates to an accurate calculation of an estimated energy usage bill for a coming month. In one embodiment, the widget 313 uses the information provided by the smart meters 213*a-c* in FIG. 2 and processed either by the system 200 or locally by the widget to generate an estimated bill.

Widget 315 allows customers to compare energy usage for different time periods. Upon clicking on the "Compare now" button in widget 315, customers or users can access widget 323 (FIG. 3C) which displays, for example, a chart comparing energy usage and temperature for two different 30 day periods. The customers or users can set the time periods by filling out form 325.

Widget 321 (FIG. 3B) displays a bar chart and plots data related to customer-generated electricity and temperature. In the illustrated embodiment the usage may be displayed by month, day, or in fifteen minute increments. The widget 321 may also calculate the average hourly generation.

Figure 4:
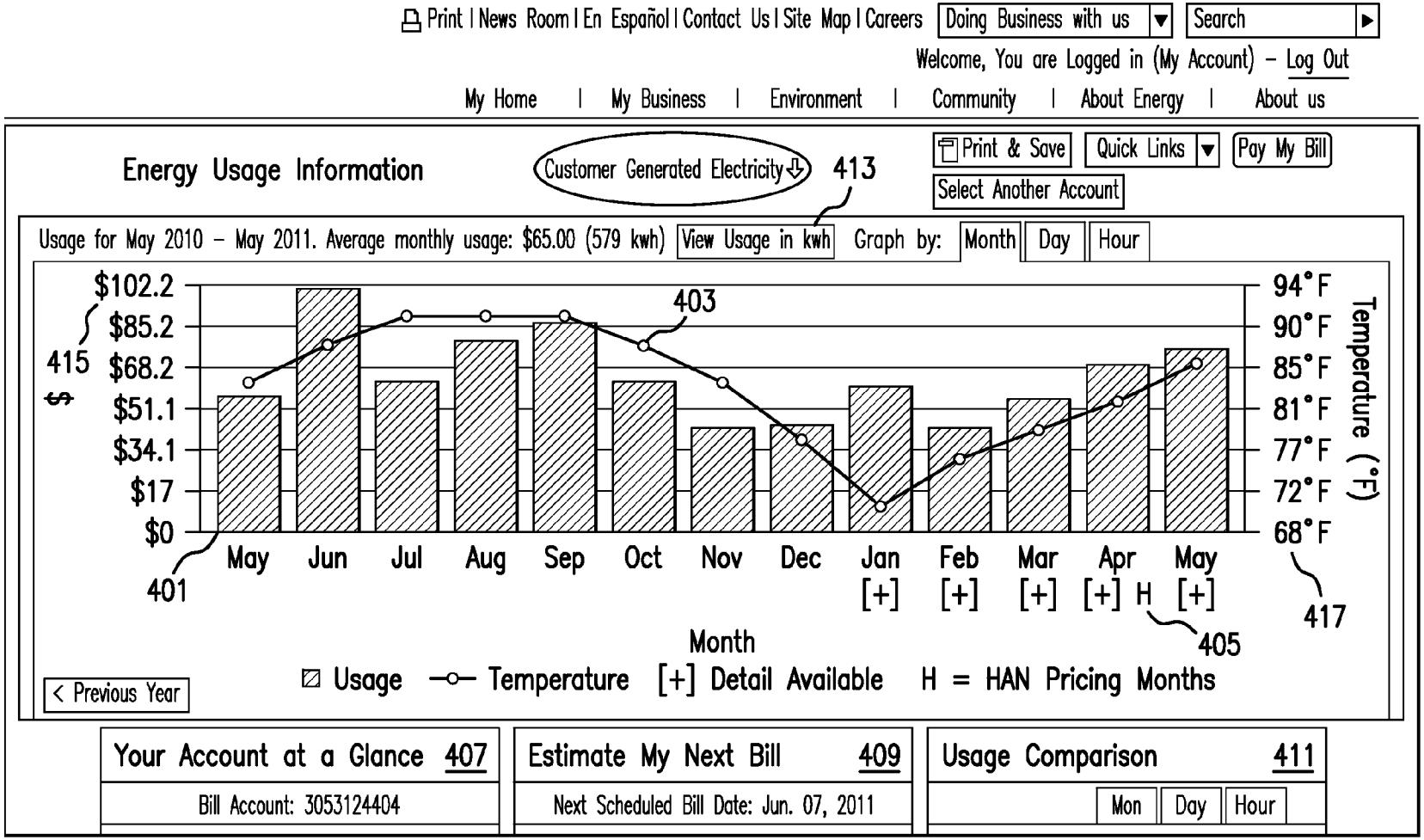
FIG. 4 is an illustration of a second user interface for the AMI customer portal in accordance with an embodiment.

FIG. 4 is an illustration of a user interface for the AMI customer portal in accordance with an embodiment. In the illustrated embodiment the GUI 400 incorporates buttons 407, 409, and 411 which, upon activation, open widgets providing information related to customer account at a glance (407), an estimate of a next bill (409), and comparison of energy usage (411).

The energy usage information widget in FIG. 4 allows users to display energy usage data in kwh (413) or based on billed amounts (415). The widget plots the temperature (403) in Fahrenheit degrees (417) for the same time period that the energy usage is displayed in the bar chart. Also, the widget may indicate which months in the bar chart are considered HAN pricing months.

Figure 5:
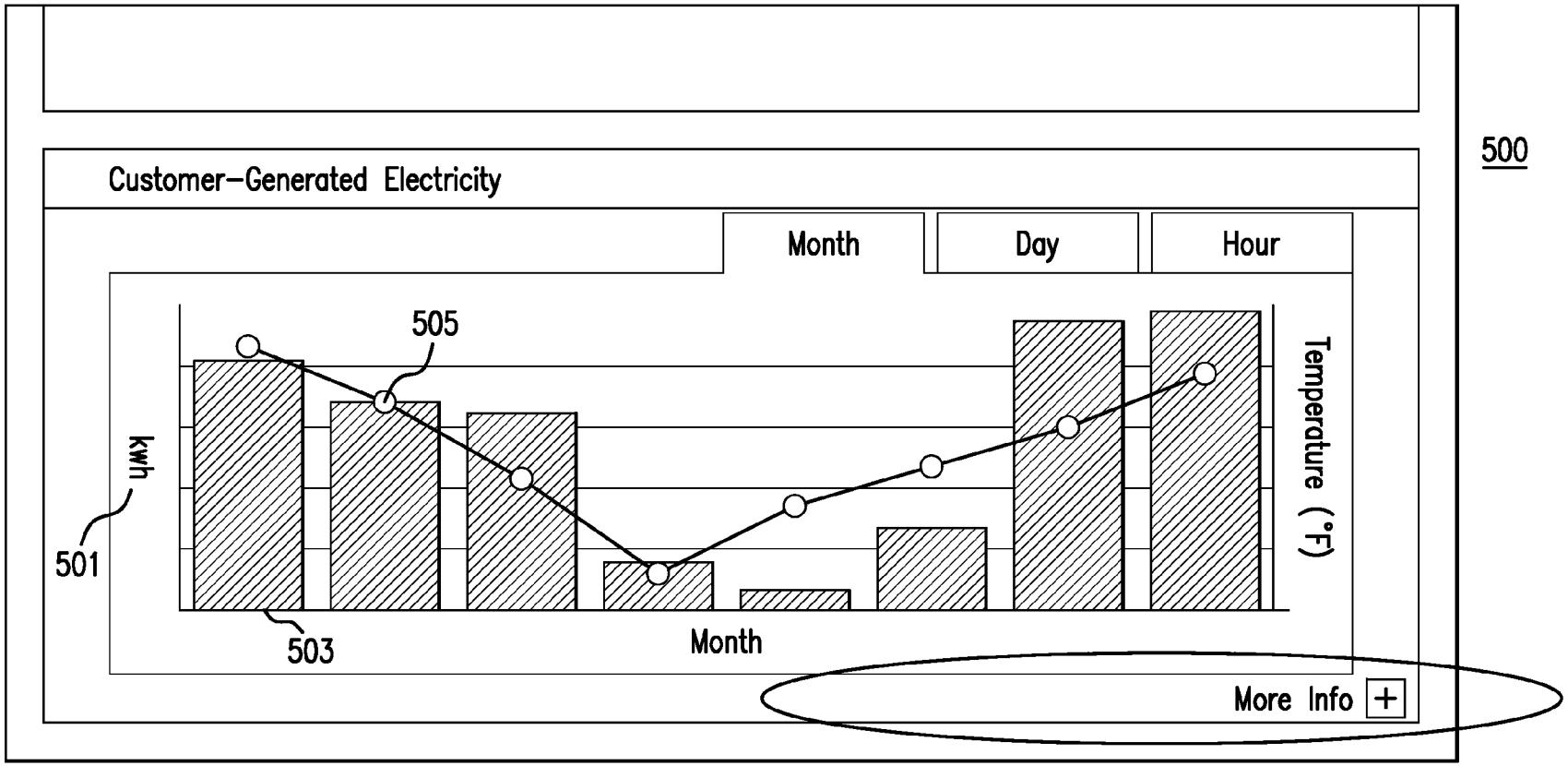
FIG. 5 is an illustration of a third user interface for the AMI customer portal in accordance with an embodiment.

FIG. 5 illustrates a minimized version or view of the customer-generated electricity widget 500 which can be expanded by clicking on the "More Info" button. In one embodiment, the information displayed in the minimized widget 500 includes temperature (505) and customer-generated electricity (503) data at a high level. For example, the height of a particular bar relates to customer-generated electricity in kwh (501), but in the illustrated embodiment no particular kwh measurements are provided.

Figure 6:
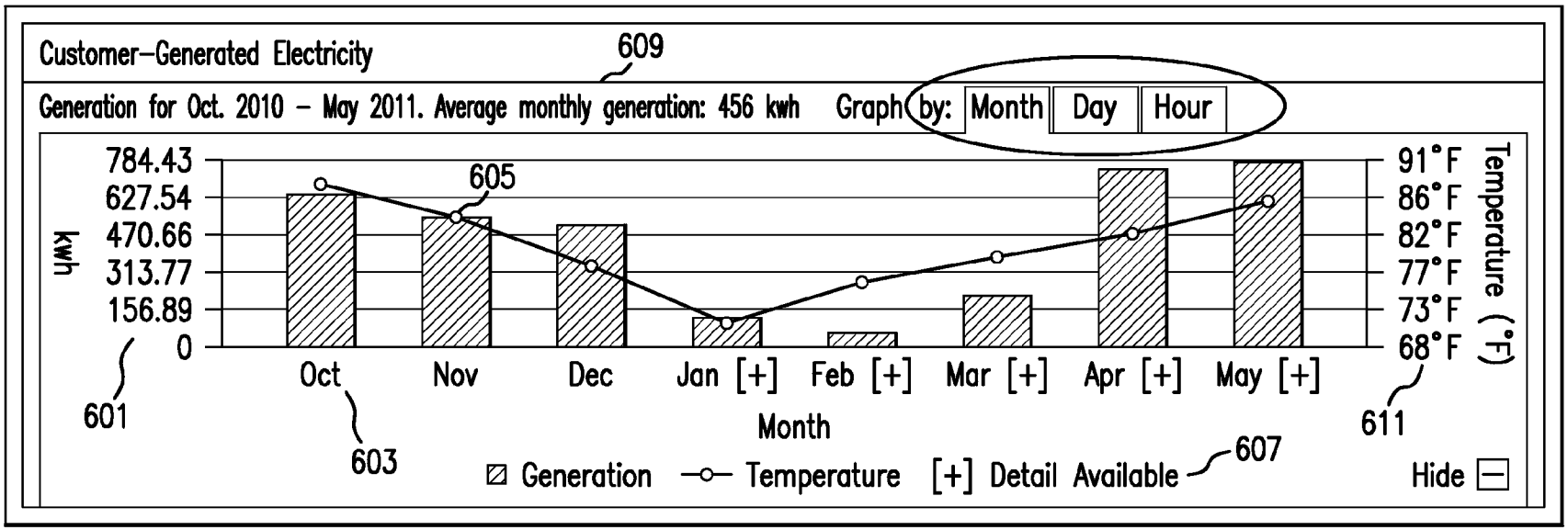
FIG. 6 is an illustration of a fourth user interface for the AMI customer portal in accordance with an embodiment.

FIG. 6 illustrates an expanded view or version (600) of the customer-generated electricity widget 500 in FIG. 5. The widget 600 may display customer-generated electricity in a bar chart format on a monthly (603), daily, or hourly basis. The widget 600 may also plot the temperature 605 overlaying the bar chart. In the expanded view or version 600, customers may also access additional customer-generated electricity details with respect to specific months in the year when those details are available. For example, the additional information may include identification of source of energy, etc. The expanded view or version of the widget 600 also provides information related to the average monthly electricity generation 609, kilowatt/hour range 601 and temperature range 611.

In one embodiment of the subject matter described herein the customer may have a plurality of sources of electricity, to power the customer's home/office. For example, the plurality of sources may include solar power, bio-gas plant, gas power turbines, and the like. The plurality of sources may be customer owned, or the electricity may be provided by a utility company, or any combination thereof.

In another embodiment, the AMI customer portal may not be limited to electricity supply. For example, the AMI customer portal may be used for water, sewerage, gas, electricity or any combination thereof.

The various embodiments and/or components, for example, the modules, elements, or components and controllers therein, also may be implemented as part of one or more computers or processors. The computer or processor may include a computing device, an input device, a display unit and an interface, for example, for accessing the Internet. The computer or processor may include a microprocessor. The microprocessor may be connected to a communication bus. The computer or processor may also include a memory. The memory may include Random Access Memory (RAM) and Read Only Memory (ROM). The computer or processor further may include a storage device, which may be a hard disk drive or a removable storage drive such as an optical disk drive, solid state disk drive (e.g., flash RAM), and the like. The storage device may also be other similar means for loading computer programs or other instructions into the computer or processor.

As used herein, the term "computer" or "module" may include any processor-based or microprocessor-based system including systems using microcontrollers, reduced instruction set computers (RISC), application specific integrated circuits (ASICs), field-programmable gate arrays (FPGAs), graphical processing units (GPUs), logic circuits, and any other circuit or processor capable of executing the functions described herein. The above examples are exemplary only, and are thus not intended to limit in any way the definition and/or meaning of the term "computer."

The computer or processor executes a set of instructions that are stored in one or more storage elements, in order to process input data. The storage elements may also store data or other information as desired or needed. The storage element may be in the form of an information source or a physical memory element within a processing machine.

The set of instructions may include various commands that instruct the computer or processor as a processing machine to perform specific operations such as the methods and processes of the various embodiments of the invention. The set of instructions may be in the form of a software program, which may form part of a tangible non-transitory computer readable medium or media. The software may be in various forms such as system software or application software. Further, the software may be in the form of a collection of separate programs or modules, a program module within a larger program or a portion of a program module. The software also may include modular programming in the form of object-oriented programming. The processing of input data by the processing machine may be in response to operator commands, or in response to results of previous processing, or in response to a request made by another processing machine.

As used herein, the terms "software", "firmware" and "algorithm" are interchangeable, and include any computer program stored in memory for execution by a computer, including RAM memory, ROM memory, EPROM memory, EEPROM memory, and non-volatile RAM (NVRAM) memory. The above memory types are exemplary only, and are thus not limiting as to the types of memory usable for storage of a computer program.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions, types of materials and coatings described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A system for an advanced metering infrastructure (AMI) customer portal is provided, the system comprises:

an AMI;

a data repository to store data received from a plurality of sources within the AMI;

a portal providing a plurality of tools to a customer at a remote location for analysis of data stored in the repository, wherein the tools are customizable by the customer.

2. A method for an advanced metering infrastructure (AMI) customer portal, the method comprising:

providing AMI meters to form an AMI network;

configuring a data repository to store data received from a plurality of sources within the AMI network;

providing a plurality of tools to a customer for analysis of data stored in the repository via a portal, wherein the tools are customizable.

3. A computer-implemented method for providing a view of energy usage data generated by at least one AMI meter, comprising:

receiving, from an application program executing on a client computing system, a request to initiate a view of selected energy usage data measured by the at least one AMI meter and corresponding to a customer;

responsive to the request to initiate the view, transmitting a graphical interface component to the requesting client computing system, wherein the graphical interface component is executed by the application program to compose the view of the selected energy usage data;

receiving, from the graphical interface component, a request for one or more elements of energy usage data obtained from a data repository containing historical and current AMI meter data;

retrieving at least one respective value corresponding to each of the requested elements of energy usage data;

transmitting the values to the graphical interface component, wherein the graphical interface component is configured to render a display of the values through the use of at least one widget.

4. The method of claim 3, wherein said one or more elements of energy usage data comprises historical energy usage information, and said values comprise first energy usage information on a monthly, daily, or hourly basis, wherein said first energy usage information comprises bill amount information or kilowatt-hour consumption information;

temperature information on a monthly, daily, or hourly basis.

5. The method of claim 4, wherein a first widget is configured to display said first energy usage information, said temperature information, and average monthly usage information.

6. The method of claim 5, wherein said first widget is configured to calculate said average monthly usage information.

7. The method of claim 3, wherein said one or more elements of energy usage data comprises bill estimate information, and said values comprise a next scheduled bill date; and a next month's calculated bill.

8. The method of claim 3, wherein said one or more elements of energy usage data comprises bill estimate information, said values comprise a next scheduled bill date and historical energy usage information;

wherein a first widget is configured to calculate a next month's bill based on said historical energy usage information.

9. The method of claim 3, wherein at least one widget is configured to be customized based on the type of energy sources used by a customer, historical energy usage data, customer's preferences as to usage of electricity, customer's monitored usage habits, or energy consumption data of the community where the customer is located.

10. The method of claim 3, wherein said one or more elements of energy usage data comprises historical energy usage information, and said values comprise first energy usage information corresponding to a first period of time, wherein said first energy usage information comprises bill amount information or kilowatt-hour consumption information;

second energy usage information corresponding to a second period of time, wherein said first energy usage information comprises bill amount information or kilowatt-hour consumption information;

first temperature information corresponding to said first period of time; and second temperature information corresponding to said second period of time.

11. The method of claim 10, wherein a first widget is configured to display said first and second energy usage information, and said first and second temperature information, wherein the first widget is further configured so that users can set said first and second periods of time.

12. A computer-readable storage medium containing a data server application, which when executed on a processor is configured to perform an operation for providing a view of energy usage data, the operation comprising: receiving, from an application program executing on a client computing system, a request to initiate a view of selected energy usage data measured by the at least one AMI meter and corresponding to a customer;

responsive to the request to initiate the view, transmitting a graphical interface component to the requesting client computing system, wherein the graphical interface component is executed by the application program to compose the view of the selected energy usage data;

receiving, from the graphical interface component, a request for one or more elements of energy usage data obtained from a data repository containing historical and current AMI meter data;

retrieving at least one respective value corresponding to each of the requested elements of energy usage data;

transmitting the values to the graphical interface component, wherein the graphical interface component is configured to render a display of the values through the use of at least one widget customizable by the customer.

13. The computer-readable storage medium of claim 12, wherein said one or more elements of energy usage data comprises historical energy usage information, and said values comprise first energy usage information on a monthly, daily, or hourly basis, wherein said first energy usage information comprises bill amount information or kilowatt-hour consumption information;

temperature information on a monthly, daily, or hourly basis.

14. The computer-readable storage medium of claim 13, wherein a first widget is configured to display said first energy usage information, said temperature information, and average monthly usage information.

15. The computer-readable storage medium of claim 14, wherein said first widget is configured to calculate said average monthly usage information.

16. The computer-readable storage medium of claim 12, wherein said one or more elements of energy usage data comprises bill estimate information, and said values comprise a next scheduled bill date; and a next month's calculated bill.

17. The computer-readable storage medium of claim 12, wherein said one or more elements of energy usage data comprises bill estimate information, said values comprise a next scheduled bill date and historical energy usage information;

wherein a first widget is configured to calculate a next month's bill based on said historical energy usage information.

18. The computer-readable storage medium of claim 12, wherein at least one widget is configured to be customized based on the type of energy sources used by a customer, historical energy usage data, customer's preferences as to usage of electricity, customer's monitored usage habits, or energy consumption data of the community where the customer is located.

19. The computer-readable storage medium of claim 12, wherein said one or more elements of energy usage data comprises historical energy usage information, and said values comprise first energy usage information corresponding to a first period of time, wherein said first energy usage information comprises bill amount information or kilowatt-hour consumption information;

second energy usage information corresponding to a second period of time, wherein said first energy usage information comprises bill amount information or kilowatt-hour consumption information;

first temperature information corresponding to said first period of time; and second temperature information corresponding to said second period of time.

20. The computer-readable storage medium of claim 19, wherein a first widget is configured to display said first and second energy usage information, and said first and second temperature information, wherein the first widget is further configured so that users can set said first and second periods of time.

* * * * *